US008136236B2

(12) United States Patent
Amato

(10) Patent No.: US 8,136,236 B2
(45) Date of Patent: Mar. 20, 2012

(54) METHOD FOR MANUFACTURING A COAXIAL CABLE

(75) Inventor: Alan John Amato, Cheshire, CT (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 136 days.

(21) Appl. No.: 12/560,336

(22) Filed: Sep. 15, 2009

(65) Prior Publication Data

US 2011/0061887 A1 Mar. 17, 2011

(51) Int. Cl.
*H01B 13/20* (2006.01)

(52) U.S. Cl. ..... 29/828; 29/825; 156/47; 174/23 C; 174/24; 174/102 R

(58) Field of Classification Search ..... 29/825, 29/828; 156/47; 174/23 C, 24, 102 R
See application file for complete search history.

(56) References Cited

U.S. PATENT DOCUMENTS

| | | | | |
|---|---|---|---|---|
| 2,673,643 | A | 3/1954 | Blank et al. | |
| 4,495,225 | A | 1/1985 | Ciuba et al. | |
| 5,278,356 | A | 1/1994 | Miller | |
| 5,593,756 | A | 1/1997 | Miller | |
| 5,779,939 | A | 7/1998 | Gerling et al. | |
| 5,795,851 | A | 8/1998 | Gerling et al. | |
| 6,265,667 | B1 | 7/2001 | Stipes et al. | |
| 6,511,741 | B1 | 1/2003 | Hungarter | |
| 6,596,393 | B1 * | 7/2003 | Houston et al. | 428/389 |
| 6,912,798 | B2 | 7/2005 | Blau et al. | |
| 6,997,999 | B2 * | 2/2006 | Houston et al. | 156/51 |
| 7,022,918 | B2 | 4/2006 | Gialenios et al. | |
| 7,048,343 | B2 | 5/2006 | Peterson et al. | |
| 7,084,343 | B1 | 8/2006 | Visser | |
| 7,244,337 | B2 | 7/2007 | Bahlmann et al. | |
| 7,438,964 | B2 | 10/2008 | Clark | |
| 7,497,010 | B2 | 3/2009 | Gialenios et al. | |
| 7,692,098 | B2 | 4/2010 | Wyatt, II et al. | |
| 2004/0007308 | A1 | 1/2004 | Houston et al. | |
| 2005/0051261 | A1 | 3/2005 | Albanese et al. | |
| 2005/0056453 | A1 | 3/2005 | Gialenios et al. | |
| 2005/0115074 | A1 | 6/2005 | Gialenios et al. | |
| 2006/0026825 | A1 | 2/2006 | Gialenios et al. | |
| 2006/0117559 | A1 | 6/2006 | Gialenios et al. | |
| 2007/0259174 | A1 | 11/2007 | Albanese et al. | |
| 2011/0061887 | A1 * | 3/2011 | Amato | 174/102 R |

OTHER PUBLICATIONS

PCT's MOCSY® 7 coaxial cable with 1PreP, available at: http://www.pctcorporate.com/images/stories/realtimedox/datasheets/cable/pct_prep%20mocsy7%20coaxial%20cable%20technology_201002.pdf—accessed on line Sep. 9, 2010.

King Industries Lubricant Additives Division, Guide to Rust Preventatives, King Industries, Inc., Norwalk, CT, USA, available at: http://www.kingindustries.com/PDFS/Rust_Preventative_Guide.pdf, accessed May 29, 2009.

Application No. PCT/US2010/048924, International Search Report and the Written Opinion of the International Searching Authority, or the Declaration. Date of Mailing: May 18, 2011. 9 pages.

* cited by examiner

*Primary Examiner* — Carl Arbes
(74) *Attorney, Agent, or Firm* — Schmeiser Olsen & Watts

(57) ABSTRACT

Corrosion resistant coaxial cable. In one example embodiment, a method for manufacturing a coaxial cable includes various steps. First, a dielectric is extruded around a center conductor. Next, the dielectric is surrounded with an outer conductor. Then, a corrosion-inhibiting composition is applied to the outer conductor. Finally, the outer conductor is surrounded with a jacket. The corrosion-inhibiting composition includes a synthetic sulfonate salt dispersed in a paraffinic mineral oil. The synthetic sulfonate salt is present in the composition in an amount of from about 5% to about 10% by weight. The paraffinic mineral oil is present in the composition in an amount of from about 90% to about 95% by weight.

14 Claims, 2 Drawing Sheets

METHOD FOR MANUFACTURING A COAXIAL CABLE

BACKGROUND

Typical coaxial cable includes one or more layers of conductive materials for radio frequency (RF) shielding. One common type of shielding material is a conductive tape that attenuates interfering electromagnetic fields more efficiently in the high frequency range. Another common type of shielding material is a conductive braid that attenuates interfering electromagnetic fields more efficiently in the low frequency range. The combination of tape and braid layers as shielding material in a coaxial cable is sometimes referred to as an outer conductor. For example, a standard-shield coaxial cable includes a center conductor surrounded by a dielectric, an outer conductor including a conductive tape and a conductive braid, and a jacket. The cable is also generally terminated with cable connectors.

One problem associated with coaxial cables is that moisture present in and around the cable can corrode the cable conductors. This corrosion negatively affects the electrical and mechanical properties of the cable. The moisture can enter the cable in several ways. For example, moisture can enter the cable through small breaks in the jacket or through improper or defective connectors. Further, moisture can enter the cable during the jacket extrusion process or during storage in high humidity environments.

Past efforts to reduce moisture-related corrosion in coaxial cables have generally focused on methods of saturating the space between the jacket and the cable conductors with a flooding compound, such as ETPR, polybutane, polybutene, amorphous polypropylene, and polyisobutylene. While these flooding methods are generally effective at reducing moisture-related corrosion, the flooding compounds themselves are relatively sticky and/or waxy. These sticky and/or waxy flooding compounds often remain on the fingers and tools of cable installation technicians after cutting or terminating a flooded coaxial cable.

Another past effort to reduce moisture-related corrosion in coaxial cables is disclosed in U.S. Pat. No. 6,997,999 (the '999 patent). The '999 patent discloses a corrosion-inhibiting composition that is applied to the outer conductor of a coaxial cable. The corrosion-inhibiting composition disclosed in the '999 patent includes three main elements: 1) a paraffinic oil, 2) a corrosion-inhibiting compound dispersed in the paraffinic oil, and 3) a stabilizer to maintain the dispersion between the corrosion-inhibiting compound and the oil. The corrosion-inhibiting compound disclosed in the '999 patent is preferably a petroleum sulfonate salt such as a calcium salt having an activity of greater than 0% to about 25% based on the calcium salt.

The '999 patent teaches that the stabilizer is necessary to prevent the preferred amounts of the corrosion-inhibiting compound from precipitating out of the oil. Specifically, the stabilizer allows for larger amounts of the corrosion-inhibiting compound (about 15% by weight or greater) to be used in the corrosion-inhibiting composition without precipitation of the corrosion-inhibiting compound. The '999 patent teaches that the corrosion-inhibiting composition preferably includes the corrosion-inhibiting compound in an amount of from about 15% to about 30% by weight. Therefore, the '999 patent teaches that the preferable amount of the corrosion-inhibiting compound would not be possible without the presence of the stabilizer. Unfortunately, however, the inclusion of a stabilizer, which is necessitated by the ues of a petroleum sulfonate salt, increases the cost and complexity of a corrosion-inhibiting composition.

SUMMARY OF SOME EXAMPLE EMBODIMENTS

In general, example embodiments of the present invention relate to corrosion resistant coaxial cable. At least some example embodiments include a corrosion-inhibiting composition applied to conductive portions of a coaxial cable. The application of the corrosion-inhibiting composition makes the coaxial cable corrosion resistant in the presence of moisture, particularly when the moisture is laden with salt. This corrosion resistance helps to maintain the electrical and mechanical properties of the coaxial cable within proper operating parameters. In addition, this corrosion resistance is accomplished without leaving a sticky or waxy residue on the fingers and tools of cable installation technicians after cutting or terminating the coaxial cable.

In one example embodiment, a method for manufacturing a coaxial cable includes various steps. First, a dielectric is extruded around a center conductor. Next, the dielectric is surrounded with an outer conductor. Then, a corrosion-inhibiting composition is applied to the outer conductor. Finally, the outer conductor is surrounded with a jacket. The corrosion-inhibiting composition includes a synthetic sulfonate salt dispersed in a paraffinic mineral oil. The synthetic sulfonate salt is present in the composition in an amount of from about 5% to about 10% by weight. The paraffinic mineral oil is present in the composition in an amount of from about 90% to about 95% by weight.

In an another example embodiment, a coaxial cable includes a center conductor surrounded by a dielectric, an outer conductor surrounding the dielectric, a corrosion-inhibiting composition applied to the outer conductor, and a jacket surrounding the outer conductor. The corrosion-inhibiting composition includes a synthetic sulfonate salt dispersed in a paraffinic mineral oil. The synthetic sulfonate salt is present in the composition in an amount of from about 5% to about 10% by weight. The paraffinic mineral oil is present in the composition in an amount of from about 90% to about 95% by weight.

In yet another example embodiment, a method for manufacturing a coaxial cable includes various steps. First, a dielectric is extruded around a center conductor. Next, a corrosion-inhibiting composition is applied to an outer conductor. Then, the dielectric is surrounded with an outer conductor. Finally, the outer conductor is surrounded with a jacket. The corrosion-inhibiting composition includes a synthetic sulfonate salt dispersed in a paraffinic mineral oil. The synthetic sulfonate salt is present in the composition in an amount of from about 5% to about 10% by weight. The paraffinic mineral oil is present in the composition in an amount of from about 90% to about 95% by weight.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter. Moreover, it is to be understood that both the foregoing general description and the following detailed description of the present invention are exemplary and explanatory and are intended to provide further explanation of the invention as claimed.

BRIEF DESCRIPTION OF THE DRAWINGS

Aspects of example embodiments of the present invention will become apparent from the following detailed description of example embodiments given in conjunction with the accompanying drawings, in which.

DETAILED DESCRIPTION OF SOME EXAMPLE EMBODIMENTS

Example embodiments of the present invention relate to corrosion resistant coaxial cable. In the following detailed description of some example embodiments, reference will now be made in detail to specific embodiments of the present invention, examples of which are illustrated in the accompanying drawings. Wherever possible, the same reference numbers will be used throughout the drawings to refer to the same or like parts. These embodiments are described in sufficient detail to enable those skilled in the art to practice the invention. Other embodiments may be utilized and structural, logical and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

I. Example Coaxial Cable

Figure 1A:
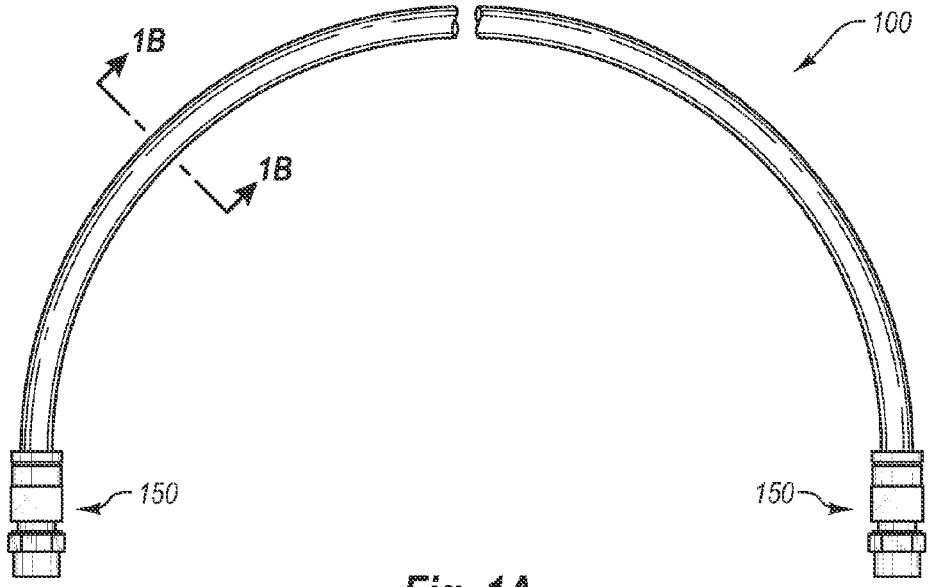
FIG. 1A is a perspective view of an example coaxial cable that terminates with two example connectors.

With reference first to FIG. 1A, an example coaxial cable 100 is disclosed. The example coaxial cable 100 can be any type of coaxial cable including, but not limited to, 50 Ohm and 75 Ohm coaxial cable. As disclosed in FIG. 1A, the example coaxial cable 100 is terminated on either end with an example connector 150. Although connectors 150 are disclosed in FIG. 1A as F-type male connectors, it is understood that cable 100 can also be terminated with other types of male and/or female connectors (not shown).

Figure 1B:
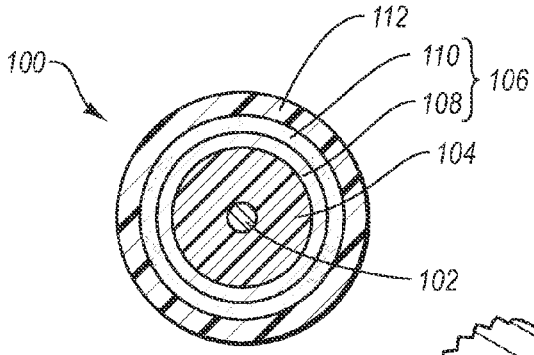
FIG. 1B is a cross-sectional view of the example coaxial cable of FIG. 1A.
Figure 1C:
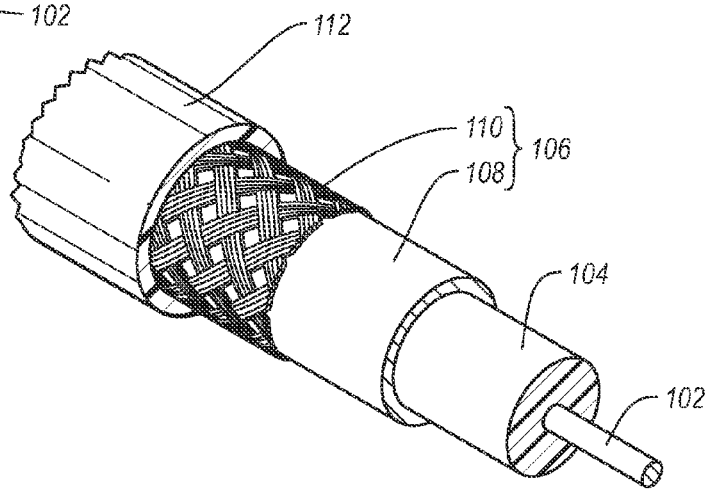
FIG. 1C is a perspective view of a portion of the coaxial cable of FIG. 1A with portions of each layer cut away.

With continuing reference to FIG. 1A, and with reference also to FIGS. 1B and 1C, the coaxial cable 100 is a standard-shield coaxial cable that generally includes a center conductor 102 surrounded by a dielectric 104, an outer conductor 106 including a conductive tape 108 and a conductive braid 110 surrounding the dielectric 104, and a jacket 112 surrounding the outer conductor 106. As used herein, the phrase "surrounded by" refers to an inner layer generally being encased by an outer layer. However, it is understood that an inner layer may be "surrounded by" an outer layer without the inner layer being immediately adjacent to the outer layer. The term "surrounded by" thus allows for the possibility of intervening layers. Each of these components of the example coaxial cable 100 will now be discussed in turn.

The center conductor 102 is positioned at the core of the example coaxial cable 100. The center conductor 102 is configured to carry a range of electrical current (amperes) as well as propagate an RF/electronic digital signal. In some example embodiments, the center conductor 102 is formed from solid copper, copper-clad aluminum (CCA), copper-clad steel (CCS), or silver-coated copper-clad steel (SCCCS), although other conductive materials are possible. For example, the center conductor 102 can be formed from any type of conductive metal or alloy. In addition, the center conductor 102 can be solid, hollow, stranded, corrugated, plated, or clad, for example.

The dielectric 104 surrounds the center conductor 102, and generally serves to support and insulate the center conductor 102 from the tape 108. Although not shown in the figures, a bonding agent, such as a polymer bonding agent, can be employed to bond the dielectric 104 to the center conductor 102. In some example embodiments, the dielectric 104 can be, but is not limited to, taped, solid, or foamed polymer or fluoropolymer. For example, the dielectric 104 can be foamed polyethylene (PE).

The tape 108 of the outer conductor 106 surrounds the dielectric 104 and generally serves to minimize the ingress and egress of high frequency electromagnetic fields to/from the center conductor 102. For example, in some applications, the tape 108 can shield against electromagnetic fields that are greater than or equal to about 50 MHz. The tape 108 is a laminate tape that can include, but is not limited to, the following layers: aluminum/polymer, bonding agent/aluminum/polymer, bonding agent/aluminum/polymer/aluminum, or aluminum/polymer/aluminum, for example. It is understood, however, that the discussion herein of tape is not limited to tape having any particular combinations of layers.

The braid 110 of the outer conductor 106 surrounds the tape 108 of the outer conductor 106. The braid 110 generally serves to minimize the ingress and egress of low frequency electromagnetic fields to/from the center conductor 102. For example, in some applications, the braid 110 can shield against electromagnetic fields that are less than about 50 MHz. The braid 110 can be formed from inter-woven, fine gauge aluminum or copper wires, such as 34 American wire gauge (AWG) wires, for example. It is understood, however, that the discussion herein of braid is not limited to braid formed from any particular type or size of wire.

The jacket 112 surrounds the outer conductor 106, and generally serves to protect the internal components of the coaxial cable 100 from external contaminants, such as dust, moisture, and oils, for example. As noted elsewhere herein, however, the jacket 112 may not always completely repel moisture from entering the coaxial cable 100. Contact with moisture results in the corrosion of the conductive components of the coaxial cable 100. In a typical embodiment, the jacket 112 also functions to protect the coaxial cable 100 (and its internal components) from being crushed or otherwise misshapen from an external force. The jacket 112 can be formed from a relatively rigid material such as, but not limited to, polyethylene (PE), high-density polyethylene (HDPE), low-density polyethylene (LDPE), or linear low-density polyethylene (LLDPE), or some combination thereof. The jacket 112 may instead be formed from a relatively less rigid and more pliable material such as, but not limited to, foamed PE, polyvinyl chloride (PVC), or polyurethane (PU), or some combination thereof. The actual material or combination of materials used might be indicated by the particular application/environment contemplated.

II. Example Method for Manufacturing a Coaxial Cable

Figure 2:
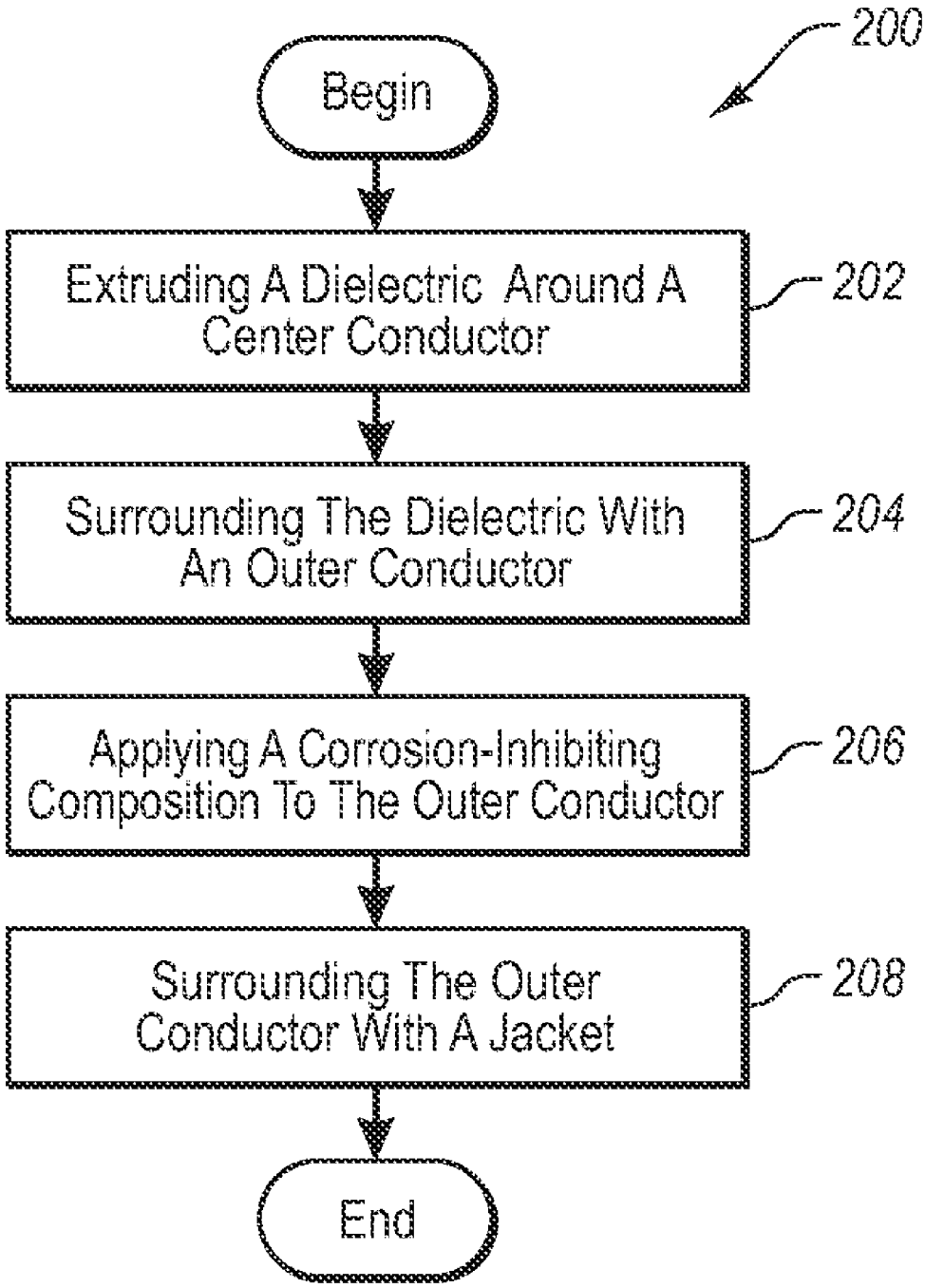
FIG. 2 is a flowchart of an example method for manufacturing the example coaxial cable of FIG. 1A.

With continued reference to FIGS. 1B and 1C, and with reference also to FIG. 2, an example method 200 for manufacturing the example coaxial cable 100 is disclosed.

At step 202, the dielectric 104 is extruded around the center conductor 102. For example, the center conductor 102 can be fed through an extruder where a pre-coat of a bonding agent, such as a polymer, is applied. The pre-coated center conductor 102 can then be fed through an extruder where the dielectric 104 is applied so as to surround the center conductor 102. Alternatively, the step 202 may be omitted altogether where the dielectric 104 has been extruded around the center conductor 102 prior to the performance of the example method 200.

Next, at step 204, the dielectric 104 is surrounded with the outer conductor 106. As noted above, the outer conductor 106 is formed from a tape 108 and a braid 110. For example, the dielectric 104 and the component(s) it surrounds can be fed through a wrapping operation that wraps the tape 108 around the dielectric 104. Similarly, the tape 108 can then be fed through a braiding operation that braids, weaves, or wraps the braid 110 around the tape 108, for example. Alternatively, the step 204 may be omitted altogether where the dielectric 104 has been surrounded with the outer conductor 106 prior to the performance of the example method 200.

At step 206, a corrosion-inhibiting composition is applied to the outer conductor 106. For example, prior to, during, and/or subsequent to the wrapping of the tape 108 around the dielectric 104, a corrosion-inhibiting composition can be applied to the tape 108. Similarly, prior to, during, and/or subsequent to the braiding operation that braids, weaves, or wraps the braid 110 around the tape 108, a corrosion-inhibiting composition can be applied to the tape 108. Thus some or all of step 206 may be performed prior to, during, or subsequent to step 204.

The corrosion-inhibiting composition includes a synthetic sulfonate salt dispersed in a paraffinic mineral oil. In some example embodiments, the synthetic sulfonate salt is an about 67% active complex of Ammonium DNNS and carboxylic acid in light naphthenic oil. One such synthetic sulfonate salt is produced under the name "KX1101" by King Industries with headquarters in Norwalk, Conn. In general, the corrosion-inhibiting composition includes an amount of from about 5% to about 10% by weight of the synthetic sulfonate salt.

The synthetic sulfonate salt is dispersed in a paraffinic mineral oil. The paraffinic mineral oil is present in the corrosion-inhibiting composition in an amount of from about 90% to about 95% by weight. It is noted that the dispersion of the synthetic sulfonate salt in the paraffinic mineral oil requires no stabilizer to maintain the dispersion between the synthetic sulfonate salt and the paraffinic mineral oil.

During step 206, the corrosion-inhibiting composition can be applied to various layers of the outer conductor 106 by any suitable means such as using felt to wipe the composition onto the layers of the outer conductor 106, using an extruder or sprayer to extrude or spray, respectively, the composition onto the layers of the outer conductor 106, and/or immersing the layers of the outer conductor 106 in the composition. As noted above, this application of the corrosion-inhibiting composition to each layer of the outer conductor 106 can occur prior to, during, or subsequent to step 204. In addition, during the step 206, heat may be applied to the outer conductor 106 resulting in the partial evaporation of the corrosion-inhibiting composition, and leaving the synthetic sulfonate salt behind on the surface(s) of the outer conductor 106.

Finally, at step 208, the jacket 112 is extruded around the outer conductor 106. For example, the outer conductor 106 and the components it surrounds can be fed through an extruder where the jacket 112 is applied so as to surround the outer conductor 106.

Thus, the example method 200 can be employed to form the example coaxial cable 100. The application of a corrosion-inhibiting composition disclosed herein to the outer conductor 106 makes the outer conductor 106 corrosion resistant in the presence of moisture, particularly when the moisture is laden with salt. This corrosion resistance helps to maintain the electrical and mechanical properties of the coaxial cable 100 within proper operating parameters. In addition, this corrosion resistance is accomplished without leaving a sticky or waxy residue on the fingers and tools of cable installation technicians after cutting or terminating the coaxial cable 100.

III. Test Results

One standard test for measuring the corrosion resistance of coaxial cable is a 1000-hour salt fog test. One such 1000-hour salt fog test was conducted simultaneously on six samples of corrosion resistant coaxial cable and six samples of standard coaxial cable. The six samples of the corrosion resistant coaxial cable each included first and second tape layers and first and second braid layers. All tape layers, braid layers, and center conductors in the six samples of the corrosion resistant coaxial cable were treated with the corrosion-inhibiting composition disclosed herein, which includes a synthetic sulfonate salt dispersed in a paraffinic mineral oil.

In the test, two samples of each cable were placed vertically into a salt fog chamber with open cable ends, two samples of each cable were placed vertically into the salt fog chamber with the top cable ends open and the bottom cable ends having a connector/port seal installed, and two samples of each cable were placed horizontally with open cable ends. After being positioned in the salt fog chamber for 1000 hours, all six samples of corrosion resistant coaxial cable showed no corrosion present on the tape layers, the braid layers, or the center conductors. In contrast, after being positioned in the salt fog chamber for 1000 hours, all six samples of standard coaxial cable did show corrosion present on the tape layers, the braid layers, and the center conductors. In particular, the various conductors of the six samples of standard coaxial cable were visibly rusted, tarnished, and/or otherwise corroded at both ends of each of the six samples.

This 1000-hour salt fog test demonstrated, therefore, that a coaxial cable treated with a corrosion-inhibiting composition disclosed herein, which includes a synthetic sulfonate salt dispersed in a paraffinic mineral oil, is superior to standard coaxial cable in terms of its corrosion resistance in the presence of salt-laden moisture. Surprisingly and advantageously, this superior corrosion resistance is achieved without requiring a stabilizer to maintain the dispersion between the synthetic sulfonate salt and the paraffinic mineral oil, thus avoiding the cost and complexity of adding a stabilizer to a corrosion-inhibiting composition.

IV. Alternative Embodiments

Although the example embodiments are described in the context of a standard-shield coaxial cable, it is understood that other cable configurations may likewise benefit from the corrosion-inhibiting composition disclosed herein. For example, conductive or metallic components of standard-shield, tri-shield, quad-shield, and/or messengered coaxial cables may benefit from the application of the corrosion-inhibiting composition. Further, other conductors or metallic components of a coaxial cable, such as the center conductor, can also benefit from the application of the corrosion-inhibiting composition. Further, although the discussion herein deals generally with coaxial cables, it is understood that other types of cables, such as other telecommunication cable types, can benefit from the corrosion-inhibiting composition being applied to internal conductive or metallic components.

The example embodiments disclosed herein may be embodied in other specific forms. The example embodiments disclosed herein are to be considered in all respects only as illustrative and not restrictive.

What is claimed is:

1. A method for manufacturing a coaxial cable, the method comprising the steps of:

extruding a dielectric around a center conductor;

surrounding the dielectric with an outer conductor;

applying a corrosion-inhibiting composition to the outer conductor, the corrosion-inhibiting composition consisting essentially of a synthetic sulfonate salt dispersed in a paraffinic mineral oil, the synthetic sulfonate salt being present in the composition in an amount of from about 5% to about 10% by weight, the paraffinic mineral oil being present in the composition in an amount of from about 90% to about 95% by weight; and surrounding the outer conductor with a jacket.

2. The method as recited in claim 1, further comprising the step of heating the coaxial cable to partially evaporate the corrosion-inhibiting composition.

3. The method as recited in claim 1, wherein the synthetic sulfonate salt has an activity of about 67%.

4. The method as recited in claim 1, wherein no stabilizer is employed to maintain the dispersion between the synthetic sulfonate salt and the paraffinic mineral oil.

5. The method as recited in claim 1, wherein said step of applying a corrosion-inhibiting composition to the outer conductor comprises wiping an outer surface of the outer conductor with the corrosion-inhibiting composition.

6. The method as recited in claim 1, wherein said step of applying a corrosion-inhibiting composition to the outer conductor comprises immersing the outer conductor in the corrosion-inhibiting composition.

7. The method as recited in claim 1, wherein said step of applying a corrosion-inhibiting composition to the outer conductor comprises the steps of:

applying the corrosion-inhibiting composition to a tape layer of the outer conductor; and applying the corrosion-inhibiting composition to a braid layer of the outer conductor.

8. The method as recited in claim 7, wherein the tape layer is laminate tape having a layer of aluminum and a braid layer is formed from interwoven aluminum or copper wires.

9. A method for manufacturing a coaxial cable, the method comprising the steps of:

extruding a dielectric around a center conductor;

applying a corrosion-inhibiting composition to an outer conductor, the corrosion-inhibiting composition consisting essentially of a synthetic sulfonate salt dispersed in a paraffinic mineral oil, the synthetic sulfonate salt being present in the composition in an amount of from about 5% to about 10% by weight, the paraffinic mineral oil being present in the composition in an amount of from about 90% to about 95% by weight;

surrounding the dielectric with the outer conductor; and surrounding the outer conductor with a jacket.

10. The method as recited in claim 9, further comprising the step of heating the coaxial cable to partially evaporate the corrosion-inhibiting composition.

11. The method as recited in claim 9, wherein the synthetic sulfonate salt has an activity of about 67%.

12. The method as recited in claim 9, wherein no stabilizer is employed to maintain the dispersion between the synthetic sulfonate salt and the paraffinic mineral oil.

13. The method as recited in claim 9, wherein the step of applying a corrosion-inhibiting composition to the outer conductor comprises wiping, spraying, or extruding an outer surface of the outer conductor with the corrosion-inhibiting composition.

14. The method as recited in claim 9, wherein the step of applying a corrosion-inhibiting composition to the outer conductor comprises immersing the outer conductor in the corrosion-inhibiting composition.

* * * * *